US005720812A

United States Patent [19]

Madrzak et al.

[11] Patent Number: 5,720,812

[45] Date of Patent: Feb. 24, 1998

[54] COATING APPARATUS AND METHOD TO DIRECTLY OR INDIRECTLY APPLY A LIQUID OR PASTY MEDIUM ONTO A MOVING LAYER OF MATERIAL

[75] Inventors: Zygmunt Madrzak, Heidenheim; Manfred Ueberschär, Nattheim, both of Germany

[73] Assignee: Voith Sulzer Papiermaschinen GmbH, Heidenheim, Germany

[21] Appl. No.: 778,170

[22] Filed: Jan. 2, 1997

[30] Foreign Application Priority Data

Jan. 2, 1996 [DE] Germany ..... 196 00 046.7

[51] Int. Cl.[6] ..... B05C 11/02; B05C 11/04; B05C 3/00

[52] U.S. Cl. ..... 118/126; 118/100; 118/107; 118/407; 118/413; 427/277; 427/355; 427/356

[58] Field of Search ..... 427/277, 355, 427/356; 118/407, 107, 100, 118, 126, 413, 110

[56] References Cited

U.S. PATENT DOCUMENTS

| | | | |
|---|---|---|---|
| 3,113,890 | 12/1963 | Johnson et al. | 118/126 |
| 3,611,987 | 10/1971 | Kohler et al. | 118/126 |
| 3,897,578 | 7/1975 | Kanda et al. | 427/358 |
| 4,038,445 | 7/1977 | Robertson | 427/150 |
| 5,117,767 | 6/1992 | Sommer | 118/126 |
| 5,436,030 | 7/1995 | Damrau | 427/240 |
| 5,454,870 | 10/1995 | Sieberth | 118/258 |
| 5,474,608 | 12/1995 | Beisswanger | 118/103 |
| 5,612,091 | 3/1997 | Paloviita et al. | 427/355 |

FOREIGN PATENT DOCUMENTS

| | | |
|---|---|---|
| 0 399 147 | 5/1989 | European Pat. Off. . |
| 91 13 268.1 | 12/1991 | Germany . |
| WO 96/19617 | 12/1994 | WIPO . |

*Primary Examiner*—Shrive Beck
*Assistant Examiner*—Michael Barr
*Attorney, Agent, or Firm*—Taylor & Associates, P.C.

[57] ABSTRACT

The invention is directed to a coating apparatus for the direct or indirect application of a liquid or pasty substance onto a moving layer of material, such as paper, carton or cardboard, with a dispenser implement and, at some distance further along the line, a spreading device for finely controlling the amount of applied medium. The dispenser implement and the spreading device share a common collector/drain surface and a common collector bin for gathering excess amounts of the liquid or pasty substance.

3 Claims, 1 Drawing Sheet

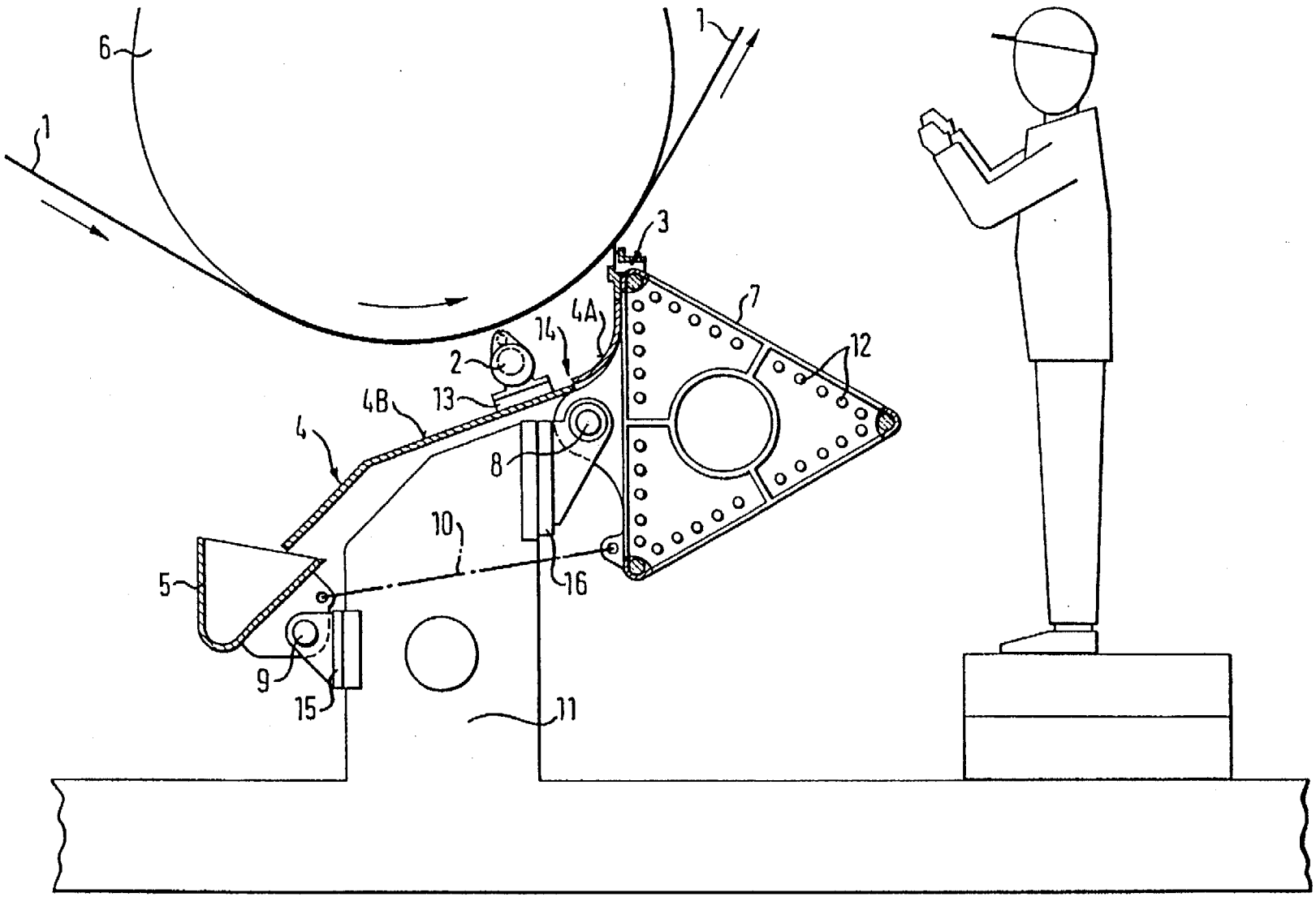
1
3
12
7
4A
14
2
13
4B
4
6
1
8
16
10
11
15
9
5

COATING APPARATUS AND METHOD TO DIRECTLY OR INDIRECTLY APPLY A LIQUID OR PASTY MEDIUM ONTO A MOVING LAYER OF MATERIAL

BACKGROUND OF THE INVENTION

1. Field of the Invention

The present invention relates to a coating apparatus for directly or indirectly applying a liquid or pasty medium onto a moving layer of material, e.g., paper or cardboard (or carton). The coating apparatus includes a dispenser implement as well as a spreading device for finely controlling the amount or thickness of the applied medium.

2. Description of the Related Art

A coating apparatus as described above typically consists of a dispenser implement that applies the liquid or pasty substance onto a moving layer of either paper or cardboard (or carton) in combination with a spreading device for finely controlling an amount of a previously applied medium, is known to exist in numerous variations. The dispersion implements are often, e.g., in the form of some kind of open jet nozzle applicators, for example. The spreading devices to control the amounts of applied medium, on the other hand, are usually equipped with some kind of wiper or blade.

The so-called direct application is performed in such a way that the layer of material, for example paper, carton, cardboard, or any sort of textile fabric, first moves past the opening of the dispenser implement and subsequently past the spreading device for finely adjusting the amount of the applied liquid or pasty substance while the moving layer itself is supported from behind by, e.g., a counter roll.

The indirect application, on the other hand, is accomplished in such a way that the liquid or pasty medium is first applied onto a dispersion roll, where a spreading device controls its amount and or thickness on the surface of the dispersion roll. After the substance is spread to the appropriate thickness it is finally transferred from the surface of the dispersion roll onto the moving layer of material.

One of the main disadvantages of conventional methods of applying substances onto moving layers is the general complexity of the overall construction of this sort of coating apparatus with all the necessary components.

What is needed in the art is a fully functional coating apparatus of the above-described type that produces high quality applications of liquid or pasty mediums, but which is constructed in a much simpler way.

SUMMARY OF THE INVENTION

The present invention provides a coating process whereby the dispersion implement and the spreading device share the same common collector/drain surface and collector bin which catch the liquid or pasty substance as it drips off the moving layer or from either the dispersion implement or the spreading device.

An advantage of the present invention over current constructions which usually feature two separate collector stations for excess liquid or pasty substance is that one less collector is required. The reduction in complexity results in an overall more compact and also less expensive coating apparatus. Another advantage is a decrease in the time required to clean the apparatus as there is only one collector site present. An additional advantage is that such a coating apparatus consumes less energy for pumping the liquid or pasty substance.

One embodiment of this invention is configured so that the dispersion implement is mounted onto or situated above the collector surface so that there is sufficient space in-between the dispersion implement and the collecting surface. This permits the liquid or pasty substance, as it is seeping and dripping off the moving surface, to be caught, collected and conducted into the collector bin. In addition, the dispersion implement is also located high enough above the common collection surface, so that excess liquid or pasty substance, as it seeps and drips off the adjacent spreading device for controlling the amount of applied medium, is allowed to flow through this passage into the common drain and collector bin. In order to conform to these requirements it is most useful if the common drain and collector surface extends from the spreading device for controlling the amount of applied medium, along and under the dispersion implement, up until the collector basin or even past this.

It is preferred that the common collector and drain surface are composed of two separate sub-sections. These sub-sections should overlap somewhere along the flow direction of the liquid or pasty substance in such a way that the sub-surface section that is upstream of the liquid or pasty substance flowing into the collector basin is situated just above the sub-surface which is downstream of the liquid or pasty substance flowing into the collector bin. This is approximately opposite to the travel direction of the moving layer of material. These sub-sections can be constructed, for example, out of sheets of stamped metal which are placed so that they overlap in the before prescribed manner. The two sheets of metal composing the sub-sections of the common drain and collector surface are loosely stacked on top of one another or mounted separately, one above the other. This sort of configuration permits these sub-surface sections to be tilted independently from one another.

One of the more favorable embodiments of this invention consists of mounting the spreading device for controlling the amount and/or thickness of the applied medium onto a support beam. This support beam is attached to a rigid support member and oriented so that it is allowed to swivel around an axis parallel to the beam's own longitudinal extension. It is further advantageous to attach the sub-section of the surface that collects the excess liquid or pasty substance, which is upstream, to this support beam. In other words, the spreading device for controlling the amount of applied medium as well as the upper sub-section of the collector/drain surface are both mounted to this beam in a very compact fashion. The advantage of this concept becomes more apparent as the support beam is tilted around the rigid support member. The tilting of the support beam would be utilized, for example, to exchange the wiper or blade of the spreading device. But it is just as useful for cleaning the coating apparatus. The movement of the support beam separates the two sub-sections of the drain and collector surfaces within the region of overlap which provides the necessary access for cleaning the collector/drain surface and the collector basin.

Since this embodiment provides only one axis of tilt for the support beam to swivel around the rigid support member, it is advantageous to design the spreading device so that the wiper or blade is attached to it by use of a Snap-On fixture. This allows fine adjustments to be made to the angle between the wiper or blade, on one side, and the counter roll that supports the moving layer, on the other side, by quickly and simply changing the fixture that holds the wiper or blade in place. Different holding fixtures hold the wiper or blade in different angular positions so that fine adjustments to the amount or thickness of the liquid or pasty substance are simply made by installing the appropriate fixture with the right holding angle. The advantage of a Snap-On fixture over current equipment is the time savings that are gained during adjustments, since the exchange does not require that any screws or bolts be loosened and tightened. The second advantage of this version of the invention is that a second tilt axis for the support beam, such as needed in current machines to make wide movements of the support beam in order to make fine adjustments to the amount or thickness of the liquid or pasty substance, is no longer necessary anymore. The invention therefore presents an embodiment that is more compact and simplified due to a less complex construction, yet be a less expensive form for a coating apparatus.

An additional functional feature added to the support beam is a so-called "beam deflection adjustment device". This device incorporates tensile or compressive support struts that contain a mechanism that applies compressive or tensile forces to counteract and thus prevent any deflections of the support beam. Furthermore, the support beam is mounted at two locations which are assigned at a certain distance away from the far ends of the support beam towards its center point along its longitudinal extension. This support arrangement for the support beam presents two advantages as, on one hand, it minimizes the amount of deflection that the beam undergoes and, on the other hand, it increases the resonance frequency to which the beam is most sensitive. The decrease in the beam's deflection allows the beam to be built with thinner walls. This, in turn, reduces the weight of the support beam even more. Since the beam deflects less and is lighter, it also requires a smaller beam deflection adjustment device. A smaller beam deflection device again reduces the load that the swivel support beam is carrying. The weight savings for the support beam in turn results in cost savings for material and construction of the coating apparatus. The increase in resonance frequency, on the other hand, is advantageous because the beam and all that it supports are less sensitive to vibrations that usually travel through the foundations of manufacturing facilities and then through the support structure.

Another embodiment of the invention features a common collector bin separately installed from the drain and collector surface to the rigid support member in a way that it is allowed to tilt around an axis that is parallel to the longitudinal extension of the entire collector system. This permits the tilting of the collector basin in order to discard accumulated excess amounts of liquid or pasty substance. The collector bin features, for obvious practical purposes, a shape that resembles a tub, sink, tube, or something similar.

Another embodiment of the invention features a mechanical link between the support beam and the collector system, in order to simultaneously swivel the support beam and the collector system. A useful version of such a mechanical link has the support beam and the collector system attached to connector rods which are hinged at their far ends. An appropriate joint to both the support beam and the collector system allows these rods, which are appropriately spaced from the swivel axes of both the support beam and the collector system, to act as levers that transfer the swing motion of the support beam over to the collector system. This sort of swing system requires only one driving mechanism for the support beam, but it moves both the support beam and the collector system. This saves a drive mechanism so that the overall construction of the coating apparatus is simpler and less expensive.

A further convenient version of the invention features the rigid support member about which the support beam swivels and the rigid support member about which the collector system swivels, consolidated into one common pedestal-like support. In order to prevent this rigid support structure from vibrating, it is suggested that this pedestal support be made out of concrete, brick, steel or similar suitable material.

It is desirable that the dispenser implement is a sort of open jet nozzle. In order to reduce the costs of the overall construction it is furthermore suggested to construct the dispenser implement as a stationary unit, so that it is not allowed to move or swivel. It is beneficial that the adjustments to the dosage of liquid or pasty substance that is emitted from the dispenser be performed by means of a spreading element, wiper, blade or metering strip. A metering strip is located between the two ledges of a metering passage where it is able to slide perpendicular to the flow direction of the seeping excess amounts of liquid or pasty substance. The surface of the metering strip that protrudes into this passage and/or the surface of the opposing ledge of the metering passage is provided with a suitable profile. The flow of liquid or pasty medium is then be finely adjusted by moving the metering strip more into or out of the metering passage. Altogether, this sort of mechanism constitutes a rather simple, compact and inexpensive solution for the coating apparatus.

The interaction between the dispenser implement and the spreading or metering device is coordinated so that of all the liquid or pasty substance applied by the dispenser, only 10% or less sticks to the moving layer of material that is being coated. The ideal target value of liquid or pasty substance to stick to the layer of material is less than 6% of the total amount of dispensed substance. The excess amount of liquid or pasty substance that does not stick then drops off and flows into the common collector bin. From there, it is transferred into a recycling unit.

Another advantageous feature of this invention is that either the counter roll, which supports the layer of material to be coated in the direct fashion, or the spreading roll, which receives the liquid or pasty substance in the indirect coating method from the dispenser before the substance is transferred onto the layer of moving material, is mounted onto a hinge, so that the respective components are enabled to swing out. This sort of swinging mechanism allows easy access to the counter roller or the spreading roller, respectively, to allow cleaning or maintenance work to take place while the rest of the apparatus is not moved out of its regular service setting.

BRIEF DESCRIPTION OF THE DRAWING

The above-mentioned and other features and advantages of this invention, and the manner of attaining them, will become more apparent and the invention will be better understood by reference to the following description of an embodiment of the invention taken in conjunction with the accompanying drawing, wherein the FIGURE depicts a schematic, side view of one embodiment of the invention.

The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown a layer of material 1, moving along the direction of the arrow, which is supported from behind by a counter roll 6 as it passes along dispenser implement 2 so that it maintains a specific distance to dispenser implement 2. After passing by dispenser implement 2, the layer of material 1 passes spreading mechanism 3 where it is steered so that it is actually in physical contact with the spreading element. Within the sequence of events of the process, i.e., the travel direction of the layer of material 1 that is being coated, spreading mechanism 3 is located so that it follows dispenser implement 2.

Somewhere on the foundation, for example on the floor of a production facility, a pedestal-like support 11 is erected that holds the major components of the coating apparatus. Two support hinges 16, which hold a support beam 7 such that it is allowed to freely swing, are firmly mounted to support 11. Support beam 7 extends across the entire width of the entire machine. The two support hinges 16 are mounted on support 11 so that they are displaced a little distance away from the far ends of support beam 7, along its longitudinal extension, towards the center of support beam 7. The distance between these two support hinges 16 is therefore less than the overall length of support beam 7.

A vast number of structural tension or compression elements or struts 12 are spaced around the entire circumference of support beam 7. These structural elements or struts 12 are equipped with mechanisms (not shown) that enable these elements or struts to apply tensile or compressive forces upon the support beam. This system of structural tension or compression elements 12 constitute a beam deflection compensation mechanism for support beam 7. A spreading device 3 finely controls the amount and/or thickness of applied medium and is mounted to support beam 7 along its upper edge. Spreading device 3 contains a spreading element such as for example a wiper, a blade or a metering strip. Spreading element 3 is conveniently attached to support beam 7 by use of a Snap-On connection. Another component that is attached to support beam 7 is the sub-sections 4A which constitute a part of the common collector/drain surface 4. This sub-section 4A is designed as a sheet metal drain collector component and it attaches on one side to spreading mechanism 3. The FIGURE shows an operating position where the upper end of the sub-section 4A is near the spreading mechanism 3 from where it bends downward.

A second sub-section 4B is designed to be a separate entity from the first sub-section 4A, and completes the common collector surfaces. Sub-section 4B begins near the region of overlap 14, from where it extends downward and to the left, as shown in the FIGURE. The region 14 where the two sub-sections 4A and 4B overlap is only roughly indicated in the accompanying FIGURE. The sub-section 4A is shown to overlap the sub-section 4B so that it is located above sub-section 4B. Just like sub-section 4A, sub-section 4B is developed as a sheet metal drain collector. Both sub-sections are just loosely stacked on top of one another around the region of overlap 14. The other end of the drain collector sub-section 4B, on the other hand, is firmly mounted to the rigid support 11.

A holding fixture 15, which is attached to the rigid support 11, supports collector bin 5 so that bin 5 is allowed to swing around. The operating position depicted in the FIGURE shows that the left end of sub-section 4B of the drain collector surface extends clearly over the opening of collector bin 5.

An open jet nozzle applicator 2 is firmly and rigidly mounted onto sub-section 4B of the common collector/drain surface 4. Between the lower surface of dispenser implement 2 shown in the FIGURE and the sub-section 4B of the common collector/drain surface 4, there are passage channels 13 distributed next to one another across the entire width of the machine.

Support beam 7, which is mounted so that it swivels about an axis 8, and the collector bin 5, which in turn is mounted so that it swivels about another axis 9, are coupled together by coupled link rods 10, which are indicated in the FIGURE by dash-dot lines. These link rods 10 are mounted to hinged joints against the support beam 7 on one side and against the collector bin 5 on the other side. The joints of link rods 10 on the support beam 7 and on the common collector bin 5 are located at certain distances to the swivel axes 8 and 9 such that a clockwise angular displacement of the support beam 7 will automatically result in a counter clockwise tilt movement of the common collector bin 5, so that collector bin 5 is emptied. When a drive mechanism, not shown in the FIGURE, causes the support beam 7 to swing downwards it simultaneously causes the common collector bin to be effectively discharged.

The operation of the coating apparatus presented in the FIGURE shows the layer of material 1, for example a layer of paper, moving past the open jet nozzle applicator 2, where a free stream of a liquid or pasty substance or medium is applied onto the layer of material 1. After this is done, the layer of material 1 passes the spreading device 3 where a spreading element adjusts the amount or thickness of the previously applied liquid or pasty substance. The excess amount of liquid or pasty substance that seeps and drips off the dispenser implement 2 as well as the spreading device 3 and onto the common collector surfaces 4 flows, forced by gravity, down along the common collector surfaces 4 and finally into the common collector bin 5. The excess substance that is shown in the FIGURE to drip off the right side of the dispenser implement 2, flows under the coating apparatus and through the passage channels 13.

When the support beam is tilted outward in a clockwise direction, for example, to exchange the spreading element or metering strip of the spreading mechanism 3, the sub-section 4A of the common drain collector surfaces 4 which is mounted to the support beam 7 is moved out at the same time. During this motion the sub-section 4A of the common drain collector surface 4 easily detaches from the sub-section 4B of the common drain collector surface 4 since they are just loosely leaning on top of one another.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coating apparatus for applying a liquid or pasty medium onto a moving surface, the moving surface being one of a roll or a fiber web, the moving surface defining a direction of travel, said coating apparatus comprising:

a dispenser implement for applying the medium onto the moving surface;

a spreading device positioned downstream from said dispenser implement relative to the direction of travel, said spreading device finely controlling an amount of the applied medium on the moving surface;

a rigid support and a support beam, said support beam mounted on said rigid support and defining a longitudinal extension, said spreading device being pivotally attached to said support beam about an axis extending substantially parallel to said longitudinal extension;

a collector/drain surface and a separate collector bin each being commonly associated with each of said dispenser implement and said spreading device for gathering excess amounts of the liquid or pasty medium, said collector/drain surface including two separate sub-sections, one of said sub-sections being positioned above an other of said sub-sections and overlapping said other sub-section relative to a direction of flow of the excess medium on said collector/drain surface, said collector bin being pivotally attached to said rigid support about an axis extending substantially parallel to said longitudinal extension; and a mechanical coupling interconnecting said support beam and said collector bin, said mechanical coupling enabling simultaneous pivotal movement between said support beam and said collector bin.

2. The coating apparatus of claim 1, wherein said mechanical coupling comprises a plurality of movable link rods, each said link rod having opposing ends respectively connected to said support beam and said collector bin.

3. A coating apparatus for applying a liquid or pasty medium onto a moving surface, the moving surface being one of a roll or a fiber web, the moving surface defining a direction of travel, said coating apparatus comprising:

a dispenser implement for applying the medium onto the moving surface;

a spreading device positioned downstream from said dispenser implement relative to the direction of travel, said spreading device finely controlling an amount of the applied medium on the moving surface; and a collector/drain surface and a collector bin each being commonly associated with each of said dispenser implement and said spreading device for gathering excess amounts of the liquid or pasty medium, said collector/drain surface including two separate sub-sections defining a common flow path, one of said sub-sections being positioned above an other of said sub-sections and overlapping said other sub-section relative to a direction of flow of the excess medium on said collector/drain surface; a rigid support and a support beam, said support beam mounted on said rigid support and defining a longitudinal extension, said spreading device being pivotally attached to said support beam about an axis extending substantially parallel to said longitudinal extension; and wherein said collector bin, which includes an open top, is separate from said collector/drain surface and is adjacent to and pivotally and directly attached to said rigid support about an axis extending substantially parallel to said longitudinal extension such that said collector bin can be emptied through said open top when pivoted.

* * * * *

UNITED STATES PATENT AND TRADEMARK OFFICE

CERTIFICATE OF CORRECTION

PATENT NO. : 5,720,812

DATED : February 24, 1998

INVENTOR(S) : Zygmunt Madrzak, et al.

It is certified that error appears in the above-identified patent and that said Letters Patent is hereby corrected as shown below:

COLUMN 3

Lines 8-9, delete "any-more".

Signed and Sealed this

Second Day of June, 1998

*Attest:*

*Attesting Officer*

BRUCE LEHMAN

*Commissioner of Patents and Trademarks*